US007690360B2

(12) United States Patent
Kuji

(10) Patent No.: US 7,690,360 B2
(45) Date of Patent: Apr. 6, 2010

(54) FUEL FEED SYSTEM FOR VEHICLE AND VEHICLE FOR IRREGULAR GROUND PROVIDED THEREWITH

(75) Inventor: Yasuhiro Kuji, Kako-gun (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 0 days.

(21) Appl. No.: 12/078,430

(22) Filed: Mar. 31, 2008

(65) Prior Publication Data

US 2008/0245344 A1 Oct. 9, 2008

(30) Foreign Application Priority Data

Apr. 3, 2007 (JP) ..... P2007-097232

(51) Int. Cl.
*F02M 37/04* (2006.01)
*F02M 37/08* (2006.01)

(52) U.S. Cl. ..... 123/509

(58) Field of Classification Search ..... 123/509, 123/510, 511, 497; 280/834; 220/835
See application file for complete search history.

(56) References Cited

U.S. PATENT DOCUMENTS

| | | | | |
|---|---|---|---|---|
| 4,844,704 | A * | 7/1989 | Jiro | 417/307 |
| 5,084,166 | A * | 1/1992 | Shiraga et al. | 210/172.4 |
| 5,787,865 | A * | 8/1998 | Harris et al. | 123/516 |
| 6,736,273 | B2 * | 5/2004 | Chiga | 210/461 |
| 7,029,582 | B2 * | 4/2006 | Sato et al. | 210/232 |
| 2001/0001963 | A1 * | 5/2001 | Murakoshi et al. | 137/565.34 |
| 2004/0109773 | A1 * | 6/2004 | Mashimo et al. | 417/423.3 |
| 2005/0201877 | A1 * | 9/2005 | Mitsudou | 417/423.14 |
| 2005/0279330 | A1 * | 12/2005 | Okazaki et al. | 123/509 |
| 2006/0273572 | A1 | 12/2006 | Yamamura | |
| 2007/0199884 | A1 * | 8/2007 | Nakagawa | 210/416.4 |
| 2007/0215122 | A1 * | 9/2007 | Nakagawa et al. | 123/509 |

* cited by examiner

*Primary Examiner*—Mahmoud Gimie
(74) *Attorney, Agent, or Firm*—Wenderoth, Lind & Ponack L.L.P.

(57) ABSTRACT

It is an object of the present invention to provide a fuel feed system for a vehicle in which, even if a small fuel quantity remains in a fuel pump, an air inhaling phenomenon is not generated when a vehicle jumps or runs on an upward slope. In the fuel feed system, a fuel pump unit is accommodated in a fuel tank, and the fuel pump unit includes a fuel pump and a fuel filter connected to a lower-end fuel suction portion of the fuel pump. The fuel filter is shaped so as to extend outward from a region of the fuel pump as seen from the above, and a filter housing for covering at least one of an upper portion and a lower portion of the fuel filter, front and rear portions of the fuel filter, and right and left portions of the fuel filter is provided with the fuel pump unit.

11 Claims, 11 Drawing Sheets

FUEL FEED SYSTEM FOR VEHICLE AND VEHICLE FOR IRREGULAR GROUND PROVIDED THEREWITH

BACKGROUND OF THE INVENTION

1. Field of the Invention

The present invention relates to a fuel feed system for a vehicle having a fuel pump unit accommodated in a fuel tank, the fuel pump unit including a fuel pump and a fuel filter connected to a lower-end fuel suction portion of the fuel pump. Moreover, the present invention relates a vehicle with a fuel feed system.

2. Description of the Prior Art

The fuel tank of the fuel feed system for a vehicle has a restricted shape and volume by the shape and width of a space where the fuel tank should be disposed. Meanwhile, the fuel tank is required to have a volume as large as possible and the fuel pump unit must be easily attached therewith.

As to a mounting position of the fuel pump unit, in the case where a large space is easily ensured below the fuel tank, the fuel pump unit is frequently mounted upright from the bottom wall of the fuel tank. On the other hand, in the case where a large space is easily ensured above the fuel tank, the fuel pump unit is frequently mounted in a hanging manner from the upper wall of the fuel tank.

Conventionally, in the structure in which the fuel pump unit is mounted in the hanging manner from the upper wall of the fuel tank, the fuel filter connected to a lower-end fuel suction portion of the fuel pump is attached in an exposed state (naked state), and the fuel filter is disposed as close as possible to the bottom wall of the fuel tank such that fuel in the fuel tank is sucked substantially completely.

However, in the case where the vehicle jumps, the vehicle runs on an upward slope, a downward slope or in a slope land, or the vehicle accelerates or decelerates with a small fuel quantity remaining in the fuel tank, the fuel is undulated in the fuel tank or the fuel is moved to one side in a backward and forward direction or a right and left direction. Therefore, air (e.g. bubbles) is mixed into the fuel or the fuel filter is temporarily exposed to the air, which sometimes results in an air inhaling phenomenon of the fuel pump. Due to the air inhaling phenomenon, power efficiency of the fuel pomp will be reduced.

In a conventional vehicle fuel feed system shown in FIG. 16 (Specification of U.S. Patent Publication No. 2006/273572), a fuel filter 103 connected to a lower-end fuel suction portion 102 of a fuel pump 101 is covered with a filter housing 105 in order to prevent the air inhaling phenomenon caused by the movement or undulation of the fuel.

A detailed structure of the fuel feed system for the vehicle of FIG. 16 will be described below. A fuel pump unit 100 is accommodated in a fuel tank 110 and is supported in the hanging manner from an upper wall 111 of the fuel tank 110. The fuel filter 103 is formed in a flattened shape, and is connected to the lower-end fuel suction portion 102 while inclined with respect to a horizontal line. Then the fuel filter 103 is disposed near a bottom wall 112 of the fuel tank 110.

A lower side, backward and forward sides, and right and left sides of the fuel filter 103 are covered with the filter housing 105. The filter housing 105 is integrally formed with a circumferential side wall cover 107 of the fuel pump 101, and is connected to the circumferential side wall of the filter housing 105 without expanding the circumferential side wall cover 107 in the backward and forward directions and the right and left directions. Although not shown, one or plural fuel flow holes are formed in the filter housing 105, and the fuel is supplied from the fuel flow hole into the filter housing 105.

However, in the fuel feed system shown in FIG. 16, an area and a shape of the fuel filter 105 as seen from above is substantially restricted so as to fit into a region of the fuel pump 101 as seen from above, and the fuel filter 105 is attached in an inclined state with respect to the horizontal plane. Therefore, the following problems are generated.

(1) Since the shape of the fuel filter 103 as seen from above is restricted to the region of the fuel pump 101 as seen from above, even if the fuel filter 103 is supported in the inclined state, a suction area of the fuel filter soaking in the fuel cannot be largely increased, and clogging during use is easily generated to decrease a suction ratio in a short time.

(2) Since the fuel filter 105 is supported in the inclined state, the upper portion of the fuel filter 105 is exposed to the air to possibly generate the air inhaling phenomenon at an early stage in the case where the remaining fuel quantity becomes small.

SUMMARY OF THE INVENTION

The present invention addresses the above described condition, and an object of the present invention is to provide a fuel feed system for a vehicle in which the vehicle can be prevented from running out of fuel while an air inhaling phenomenon is prevented in the fuel pump even if the vehicle jumps, accelerates or decelerates, or runs on an upward slope with the small fuel quantity remaining in the fuel tank.

In order to solve the above-mentioned problems, according to a first aspect of the present invention, there is provided a fuel feed system for a vehicle having a fuel pump unit accommodated in a fuel tank, the fuel pump unit including a fuel pump and a fuel filter connected to a lower-end fuel suction portion of the fuel pump, wherein the filter is shaped so as to extend outward from a region of the fuel pump as seen from the above, and a filter housing for covering at least one of an upper portion and a lower portion of the fuel filter, front and rear portions of the fuel filter, and right and left portions of the fuel filter is provided with the fuel pump unit.

With this configuration, (1) the fuel remaining in the filter housing surrounding the fuel filter is prevented from largely moving or undulating even when the vehicle jumps, runs on the upward slope or downward slope or in the slope land, or accelerates or decelerates. Therefore, mixture of the air into the fuel, exposure of the fuel filter to the air over the fuel level and air inhaling phenomenon in the fuel pump can be prevented even if the small fuel quantity remains in the fuel tank. Further, un-out of the fuel caused by the bubble generating can be reduced by preventing the air inhaling phenomenon.

(2) Since the filter is shaped so as to extend outward from the region of the fuel pump as seen from the above, the fuel suction area of the fuel filter can widely be ensured, the generation of clogging during use can be lowered, and pressure loss can be suppressed to maintain the fuel suction ratio at a high level.

In accordance with a second aspect of the present invention, there is provided to a fuel feed system for a vehicle having a fuel pump unit accommodated in a fuel tank, the fuel pump unit including a fuel pump and a fuel filter connected to a lower-end fuel suction portion of the fuel pump, wherein the fuel pump is a rotary pump, the fuel filter is shaped so as to extend outward from a region of the fuel pump region as seen in a pump axis direction, and a filter housing for covering at least one of an upper portion and a lower portion of the fuel filter, front and rear portions of the fuel filter, and right and left portions of the fuel filter is provided with the fuel pump unit. Above the rotary pump is, for example a trochoid pump having a rotating rotor.

With this configuration, the same effect as the first aspect of the present invention is obtained when the fuel pump unit is mounted to the fuel tank such that the pump axis of the fuel pump is extended in the vertical direction, and the same effect as the first aspect of the present invention is also obtained even when the fuel pump unit is mounted to the fuel tank with the pump axis inclined with respect to the vertical line.

According to the present invention, preferably the fuel filter may be formed in a flatten shape and arranged substantially in a horizontal position or arranged perpendicular to a pump axis.

With this configuration, when the bottom wall of the fuel tank is shaped in a substantially plane state, the whole of the fuel filter can be evenly brought close to the bottom wall of the fuel tank by putting a plane surface of the fuel filter along the bottom wall of the fuel tank. Therefore, in the case where the small fuel quantity remains in the fuel tank, the bobble generation phenomenon can be prevented more effectively.

According to the present invention, more preferably, the filter housing may be supported by the fuel pump unit.

With this configuration, the fuel pump unit can be assembled in the fuel tank with the filter housing previously supported by the fuel pump unit, whereby, it can facilitate the assembly work of the fuel pump unit and filter housing.

According to the present invention, more preferably, the filter housing may include a housing upper wall for covering the upper portion of the fuel filter, a housing bottom wall for covering the lower portion of the fuel filter, and a housing circumferential side wall for covering the front and rear portions and the right and left portions of the fuel filter, the housing bottom wall may be formed integrally with the housing circumferential side wall, and the housing upper wall may be formed independently of the housing bottom wall and the housing circumferential side wall.

With this configuration, since the housing bottom wall and the housing circumferential side wall are integrally formed, the filter housing can easily be produced by press molding.

According to the present invention, more preferably, the housing upper wall may be integrally formed with a pump cover of the fuel pump unit.

With this configuration, the process of separately molding only the housing upper wall can be eliminated to easily produce the filter housing.

According to the present invention, more preferably, the filter housing may include a housing upper wall for covering the upper portion of the fuel filter, a housing bottom wall for covering the lower portion of the fuel filter, and a housing circumferential side wall for covering the front and rear portions and the right and left portions of the fuel filter, the housing upper wall may be formed integrally with the housing circumferential side wall, and the housing bottom wall may be formed independently of the housing upper wall and the housing circumferential side wall.

With this configuration, since the housing upper wall and housing circumferential side wall are integrally formed, the fuel filter housing can easily be produced by press molding.

According to the present invention, more preferably, a fuel flow hole for communicating between inside and outside of the filter housing may be made in a lower end portion of the filter housing or near the lower end portion of the filter housing.

With this configuration, even when the small fuel quantity remains in the fuel tank, the fuel can rapidly be reserved in the filter housing when the vehicle stops or runs normally.

According to the present invention, more preferably, a length of an upper space portion of the filter housing in the direction of backward and forward may be larger than a length of a lower space portion of the filter housing in the direction of backward and forward, and the fuel filter may be accommodated in the lower space portion of the filter housing.

With this configuration, since the fuel filter is positioned in a small space of the filter housing, the fuel filter soaps enough in the fuel of the small space.

The present invention also provides a vehicle for irregular ground comprising a fuel feed system, the fuel feed system having a fuel pump unit accommodated in a fuel tank, the fuel pump unit including a fuel pump and a fuel filter connected to a lower-end fuel suction portion of the fuel pump, wherein the filter is shaped so as to be extended outward from a region of the fuel pump as seen from the above, and a filter housing for covering at least one of an upper portion and a lower portion of the fuel filter, front and rear portions of the fuel filter, and right and left portions of the fuel filter is provided with the fuel pump unit.

With this configuration, the same effect as the fuel feed system can be obtained.

According to the present invention of the vehicle, preferably, a pair of front wheels and a pair of rear wheels are provided for a four-wheeled vehicle, the fuel tank may be arranged at a center portion in a right and left width of the vehicle, and the fuel pump unit is arranged at a center portion in a right and left width of the fuel tank.

With this configuration, since the fuel pump unit is arranged at a center portion in a right and left direction of the fuel tank, the air inhaling phenomenon is more prevented.

According to the present invention of the vehicle, more preferably, the fuel tank may be arranged between a right rear wheel and a left rear wheel.

With this configuration, even when performing a wheelie, the air inhaling phenomenon is more prevented.

THE BRIEF DESCRIPTION OF THE DRAWINGS

The above and other objects, features and advantages of the present invention will be become more apparent from the following description taken in connection with the accompanying drawings, in which.

DETAILED DESCRIPTION OF THE INVENTION

First Embodiment

FIGS. 1 to 10 show a fuel feed system for a vehicle and a straddle-type four-wheeled vehicle for irregular ground is provided with the fuel feed system according to the present invention. A first embodiment of the present invention will be described below based on the drawings.

(Overall Structure of Straddle-Type Four-Wheeled Vehicle for Irregular Ground)

Figure 1:
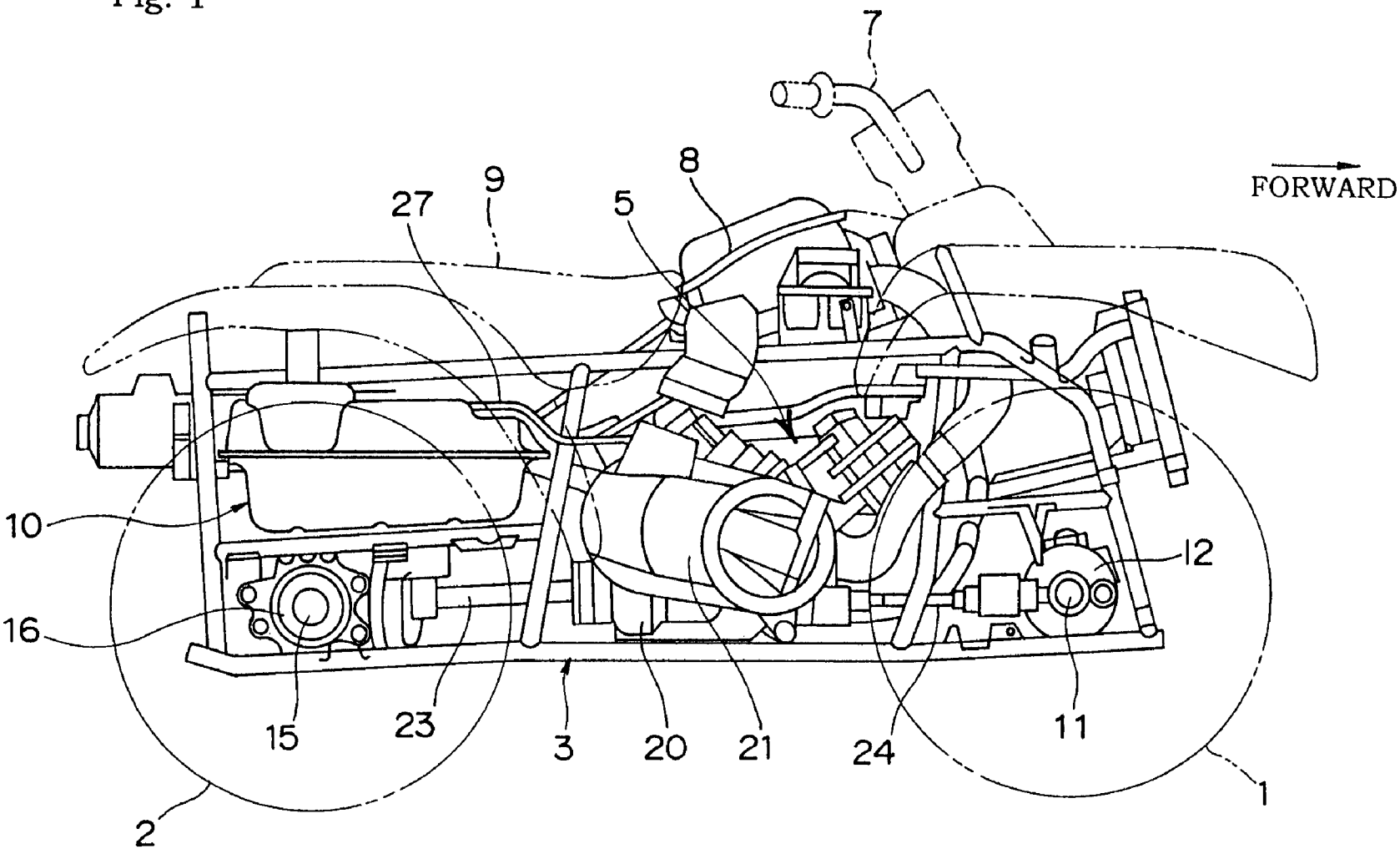
FIG. 1 is a side view showing a straddle-type four-wheeled vehicle for irregular ground provided with a fuel feed system according to the present invention.
Figure 2:
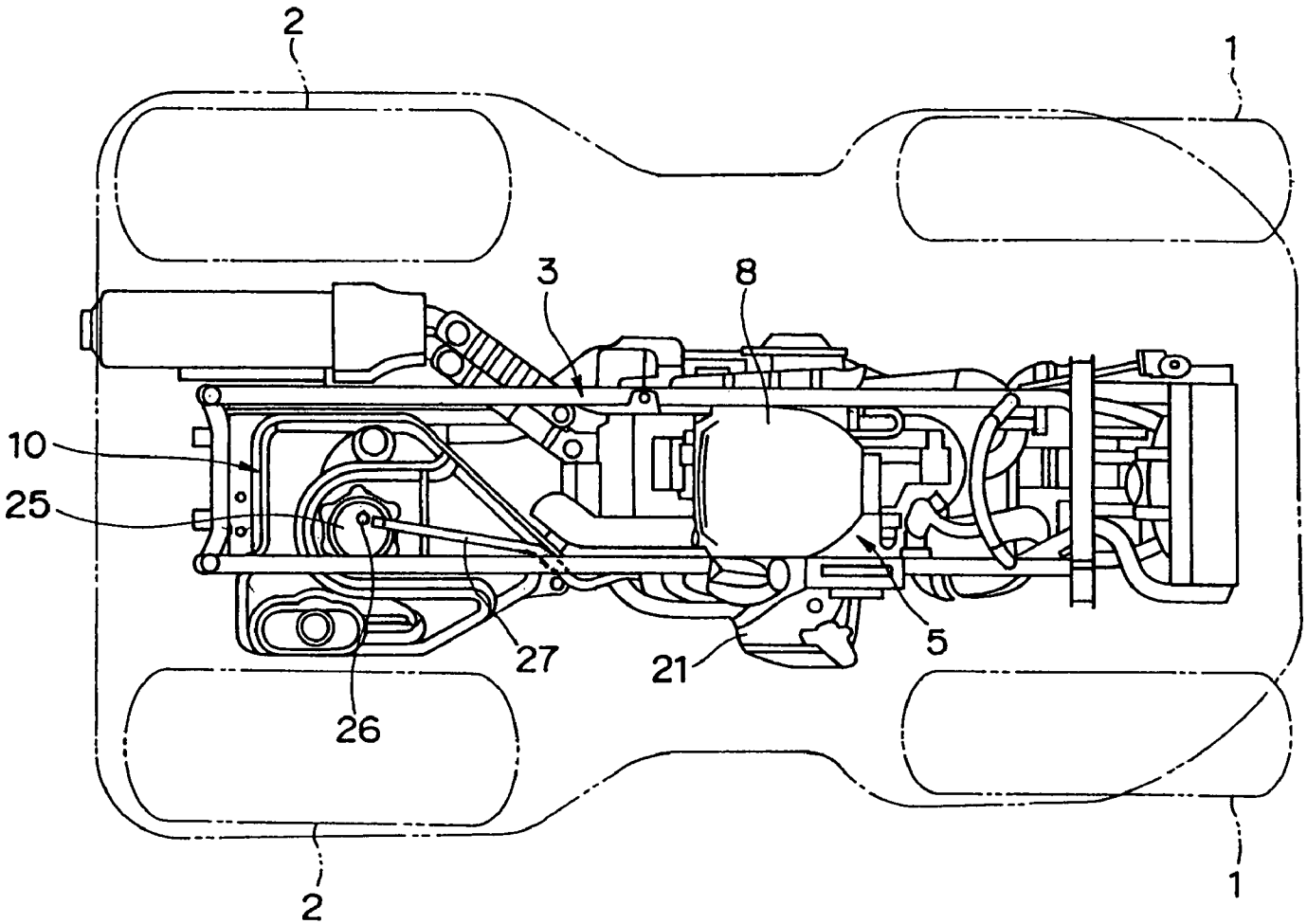
FIG. 2 is a plan view showing the straddle-type four-wheeled vehicle for irregular ground of FIG. 1.

FIG. 1 is a side view showing the straddle-type four-wheeled vehicle for irregular ground, and FIG. 2 is a plan view showing the straddle-type four-wheeled vehicle for irregular ground. Referring to FIG. 1, a pair of front wheels 1 is provided in a front portion of the vehicle while a pair of rear wheels 2 is provided in a rear portion of the vehicle, an engine 5 is mounted between the front wheel 1 and the rear wheel 2 in the backward and forward direction in a body frame 3, and a handle bar 7, an air suction box 8, a seat 9 are provided in the order from the front side in an upper portion of the vehicle. A front axle 11 of the front wheel 1 is coupled to a front-wheel differential gear (or final speed reduction gear) 12 disposed in a front-lower end portion of the body frame 3, and a rear axle 15 of the rear wheel 2 is coupled to a rear-wheel differential gear (or final speed reduction gear) 16 disposed in a rear-lower end portion of the body frame 3.

A gear type transmission 20 is provided in a rear portion of a crankcase of the engine 5, and a V-belt type continuously variable transmission 21 is provided over from a right side face of the engine 5 to a right side face of the gear type transmission 20. In a power takeoff portion of the gear type transmission 20, a rear-wheel drive shaft 23 extended backward and a front-wheel drive shaft 24 extended forward are coupled to each other, a rear-end portion of the rear-wheel drive shaft 23 is coupled to an input portion of the rear-wheel differential gear 16, and a front-end portion of the front-wheel drive shaft 24 is coupled to an input portion of the front-wheel differential gear 12.

The fuel tank 10 which is of a component of the vehicle fuel feed system is disposed in a vertical space between a last half portion of the seat 9 and the rear-wheel differential gear 16 and rear-wheel drive shaft 23. The fuel tank 10 has a long rectangular shape in the backward and forward direction when viewed from the side face.

Referring to FIG. 2, a shape of the fuel tank 10 as seen from above is formed in a substantially pentagonal shape, such as a home plate for baseball, having a V-shape front-end portion. A fuel pump unit 25 accommodated in the fuel tank 10 is disposed at a substantially central position in the right and left width of the fuel tank 10 and at a substantially central position in the backward and forward width of a substantially-rectangular last half portion except for the V-shape front-end portion. A fuel outlet portion 26 of the fuel pump unit 25 is connected to a throttle of the engine 5 through a fuel hose 27 extended forward.

(Detailed Structure of Vehicle Fuel Feed System)

Figure 3:
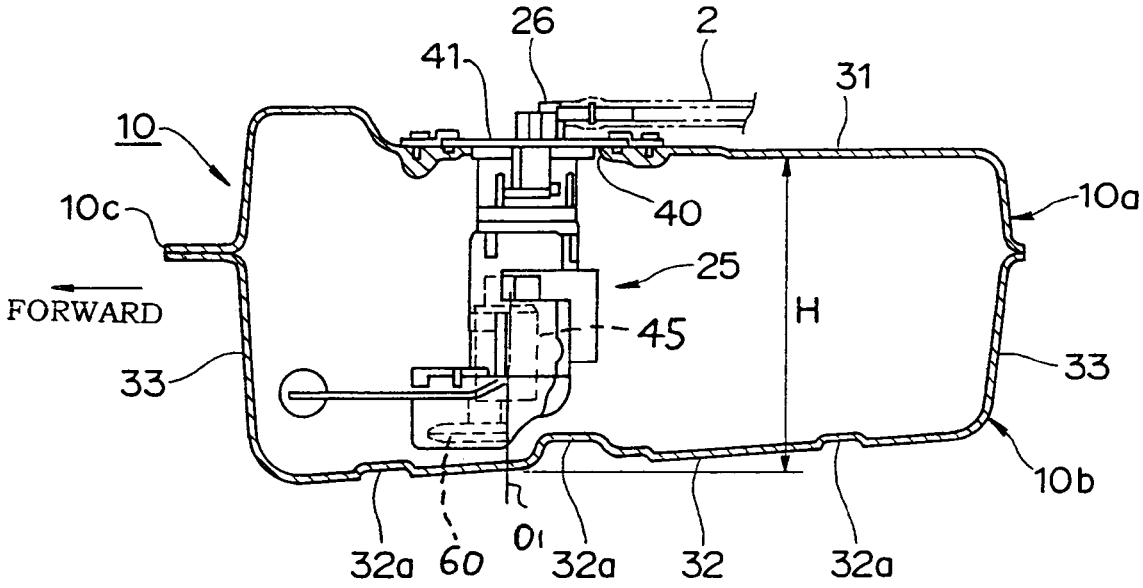
FIG. 3 is a longitudinal sectional view showing a fuel tank of the fuel feed system according to a first embodiment of the present invention.
Figure 4:
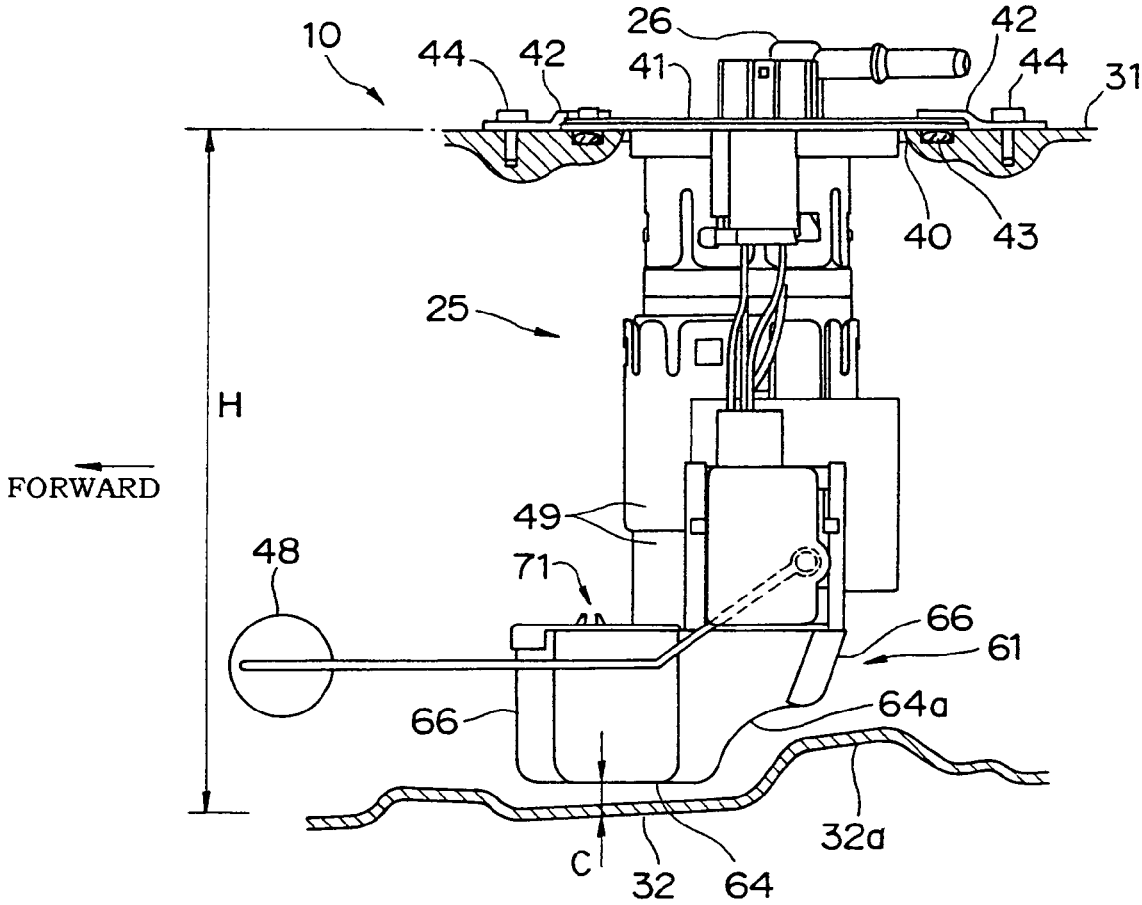
FIG. 4 shows a left side view of a fuel pump unit.
Figure 5:
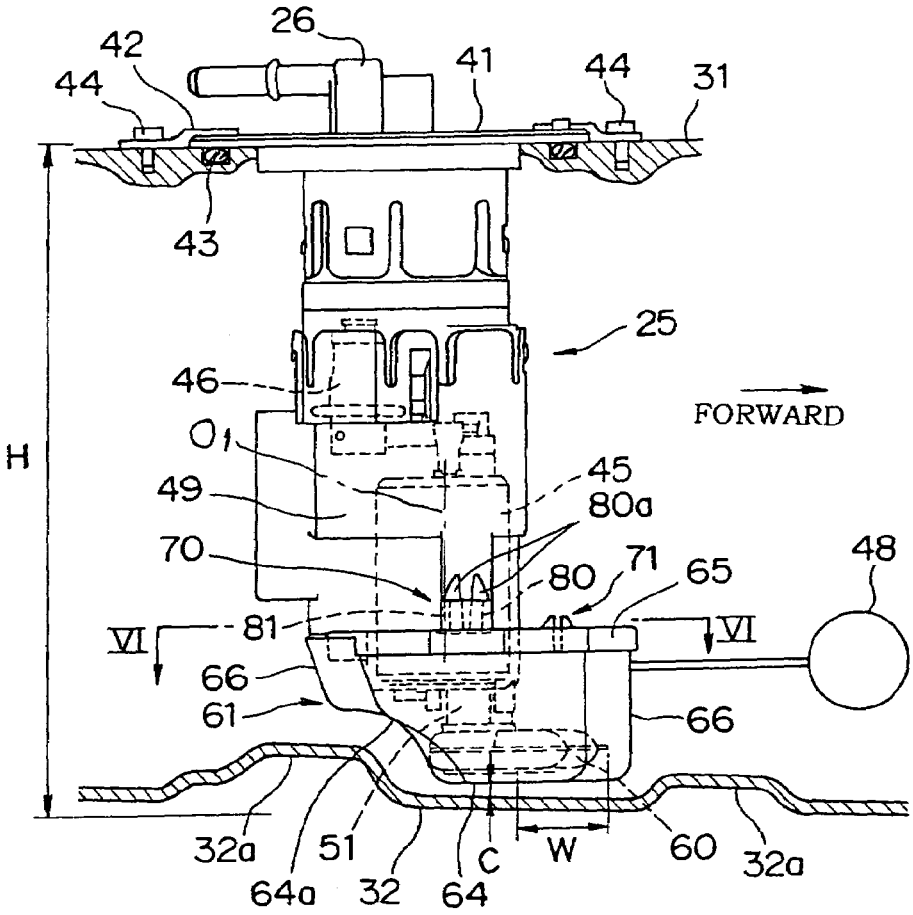
FIG. 5 shows a right side view of the fuel pump unit.
Figure 6:
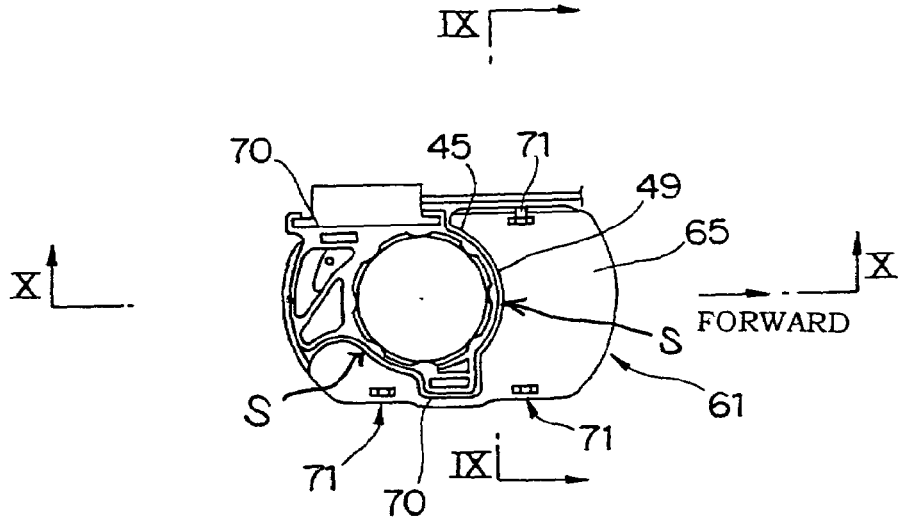
FIG. 6 shows a sectional view taken along line VI-VI of FIG. 5.
Figure 7:
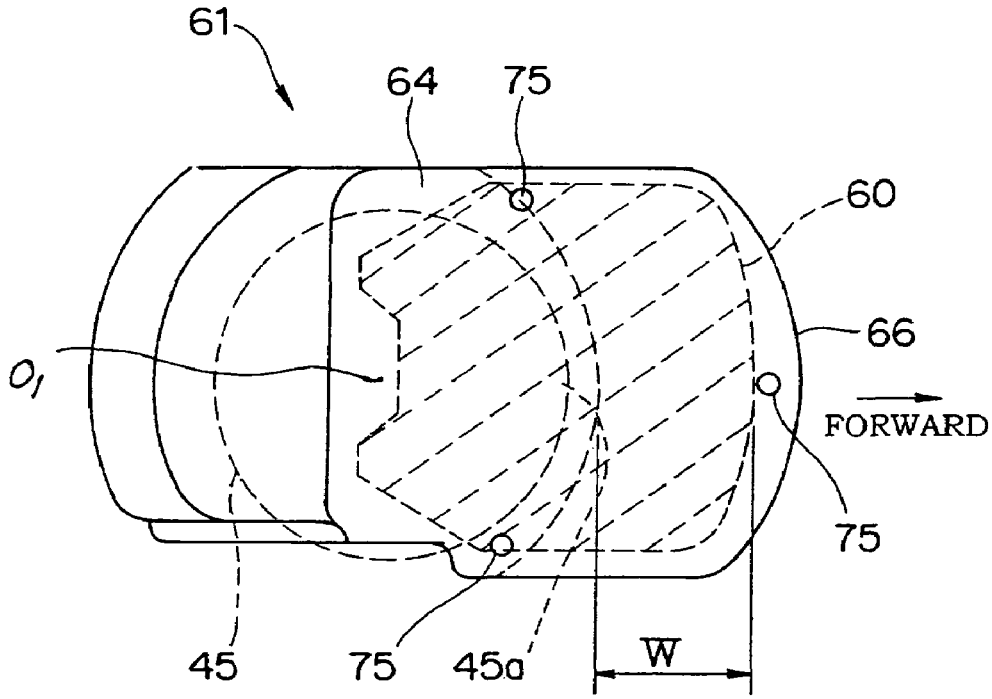
FIG. 7 shows a bottom view of a filter housing.
Figure 8:
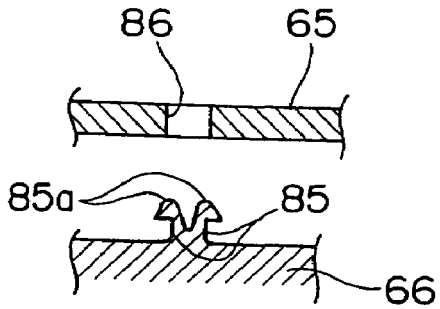
FIG. 8 is a sectional view showing an example of housing upper wall amounting means.
Figure 9:
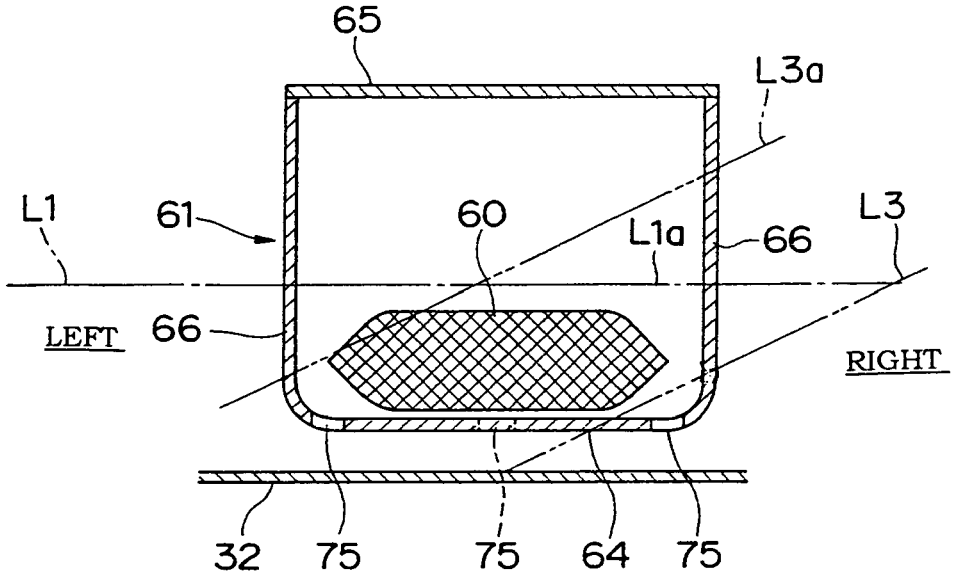
FIG. 9 shows a sectional view taken along line IX-IX of FIG. 6.
Figure 10:
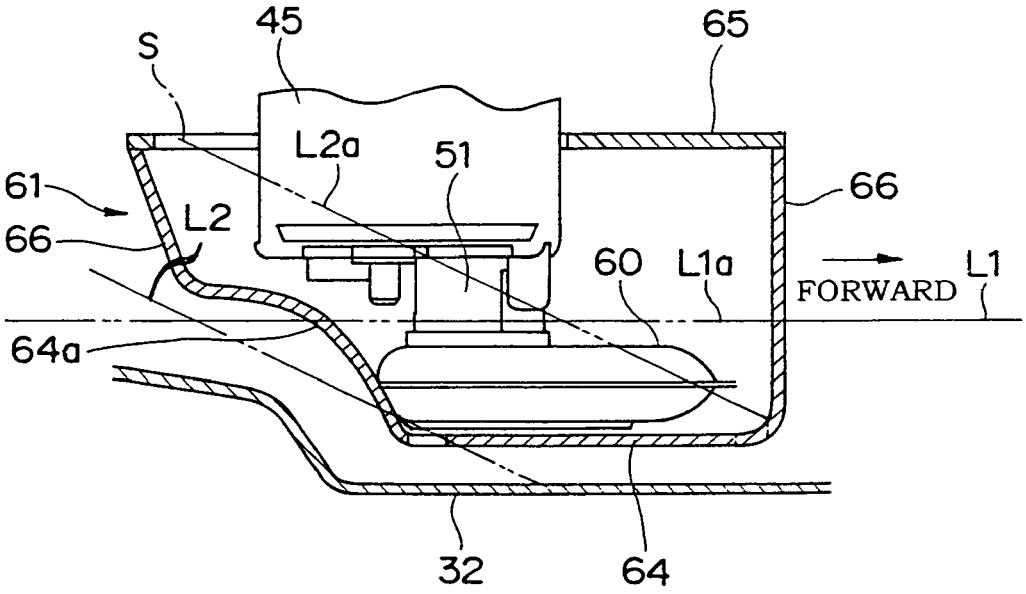
FIG. 10 shows a sectional view taken along line X-X of FIG. 6.

FIG. 3 is a longitudinal sectional view of the fuel tank 10, FIG. 4 is a left side view of the fuel pump unit 25, FIG. 5 is a right side view of the fuel pump unit 25, FIG. 6 is a sectional view taken along line VI-VI of FIG. 5, FIG. 7 is a bottom view of a filter housing 61, FIG. 8 is a sectional view showing an example of means for attaching a housing upper wall 65, FIG. 9 is a sectional view taken along line IX-IX of FIG. 6, and FIG. 10 is a sectional view taken along line X-X of FIG. 6. Referring to FIG. 3, a pair of cup-shaped tank forming members 10*a* and 10*b* is coupled in a coupling portion 10*c* by blow molding or welding to form the fuel tank 10. A fuel tank chamber of the fuel tank 10 is defined by a substantially horizontal flat upper wall 31, a substantially flat bottom wall 32 inclined slightly forward, and front and rear and right and left circumferential side walls 33. Plural rib portions 32*a* raised upward are formed at predetermined intervals in the backward and forward direction in the bottom wall 32 of the fuel tank 10. In the upper wall 31 of the fuel tank 10, a pump insertion hole 40 is formed at a position where the fuel pump unit 25 should be disposed, and the fuel pump unit 25 is inserted from the pump insertion hole 40 into the fuel tank chamber.

Referring to FIG. 4, a mounting flange 41 is formed at an upper end of the fuel pump unit 25, the mounting flange 41 is placed in the circumferential portion of the pump insertion hole 40 in the upper wall 31 of the fuel tank 10 while an O-ring 43 is interposed therebetween, and the mounting flange 41 is pressed from above by a ring: presser 42. A sectional shape of the ring presser 42 is formed in a step shape whose outer peripheral portion is lowered, and the lowered outer peripheral portion is fastened to the upper wall 31 of the fuel tank 10 by plural bolts 44. Thus, the upper-end mounting flange 41 of the fuel pump unit 25 is fixed to the upper wall 31 of the fuel tank 10, and the fuel pump unit 25 is supported in the hanging manner in the fuel tank chamber.

Referring to FIG. 5, the fuel pump unit 25 includes a fuel pump 45, a pressure regulator 46 disposed above the fuel pump 45, a fuel channel forming member, a float 48 detecting a fuel level in the fuel tank 10, and a pump cover 49 with which the outer peripheral side of the fuel pump 45 is covered. A fuel suction portion 51 is provided in a lower end portion of the fuel pump unit 25, and a fuel filter 60 is connected to a lower end portion of the fuel suction portion 51. A fuel outlet portion 26 provided in an upper end portion of the fuel pump unit 25 is projected upward from the upper wall 31 of the fuel tank 10.

The fuel filter 60 is formed in a flattened bag shape by net or non-woven fabric, the fuel filter 60 is supported in an open-sided manner by the fuel suction portion 51 with the flattened surfaces located above and below, and the fuel filter 60 is substantially horizontally extended forward in the neighborhood of the bottom wall 32 of the fuel tank 10. The flattened upper and lower surfaces of the fuel filter 60 are vertically separated from each other while the fuel can be filtered. In the first embodiment of the present invention, a rotary pump such as a trochoid pump having a rotor is provided as the fuel pump 45, the fuel pump unit 25 is mounted to the fuel tank 10 such that a pump axis O1 of the rotary pump is extended in a vertical direction, and the fuel filter 60 is attached to the fuel pump 45 so as to be perpendicular to the pump axis O1 of the rotary pump.

Referring to FIG. 7, a shape of the fuel filter 60 is shown by diagonal lines (hatching lines). When the fuel filter 60 is seen from the above, at least a part of the fuel filter 60 is extended outward from a region of the fuel pump 45. In the first embodiment, the fuel filter 60 has a right and left width similar to that of the fuel pump 45, and the fuel filter 60 is extended forward with the substantially even right and left width, the fuel filter 60 is extended forward beyond a front end 45*a* of the fuel pump 45, and the fuel filter 60 is extended forward by a predetermined distance W from the front end 45*a* of the fuel pump 45. For example, the predetermined distance W is about one-seconds to two-thirds of the width of the fuel pump 45 in the backward and forward direction. In the first embodiment, since the fuel pump unit 25 is also disposed such that the pump axis O1 is extended in the vertical direction, at least a part of the fuel filter 60 is extended outward from the region of the fuel pump 45 in the direction of the pump axis O1 when the fuel filter 60 is seen in the direction of the pump axis O1.

(Configuration of Filter Housing 61 of Vehicle Fuel Feed System)

Referring to FIG. 5, a filter housing 61 is mounted to the lower end portion of the fuel pump unit 25, the front and rear portions. Right and left portions and the upper and lower portions of the fuel filter 60 are covered with the filter housing 61. Particularly, the filter housing 61 includes a housing bottom wall 64 with which the lower portion of the fuel filter 60 is covered, a housing upper wall 65 with which the upper portion of the fuel filter 60 is covered, and a housing circumferential side wall 66 with which the front and rear portions and the right and left portions of the fuel filter 60 are covered. In the first embodiment, the housing bottom wall 64 and the housing circumferential side wall 66 are integrally formed in a cup shape, and the housing bottom wall 64 and the housing circumferential side wall 66 are mounted to the lower end portion of the pump cover 49 by fitting means 70. On the other hand, the housing upper wall 65 is separately formed independently of the housing bottom wall 64 and the housing circumferential side wall 66, and the housing upper wall 65 is mounted to the upper end of the housing circumferential side wall 66 by fitting means 71.

The housing bottom wall 64 is substantially horizontally formed in a flat shape, and a recess 64*a* is formed in the rear end portion of the housing bottom wall 64 to avoid interference with the rib 32*a* of the bottom wall 32 of the fuel tank 10. The substantially flat portion of the housing bottom wall 64 is separated by a predetermined gap C from the bottom wall 32 of the fuel tank 10. For example, the predetermined gap C is set slightly larger than a production permissible error of a height H (vertical size) in the position where the fuel pump unit 25 of the fuel tank 10 is disposed.

Referring to FIG. 7, in the housing bottom wall 64, fuel flow holes 75 having diameters ranging from about one millimeter to several millimeters are made at three points, i.e., the central portion of the right and left width in the front end portion and right and left end portions in the rear portion, in order to take the fuel into the filter housing 61. The fuel flow holes 75 communicate between inside and outside of the filter housing 61.

Referring to FIG. 6, the rear end portion of the housing upper wall 65 is formed so as to have a gap S with the rear end portion of the fuel pump 45, so that the fuel can also be taken into the filter housing 61 from the gap S.

Referring to FIG. 5, in the fitting means 70 for attaching the integral member of the housing circumferential side wall 66 and the housing bottom wall 64 to the lower end of the pump cover 49, engagement pawls 80 projected upward in a V-shape are formed at plural points at the upper end of the housing circumferential side wall 66, and the engagement pawl 80 has a return portion 80*a* in the upper end portion thereof. On the other hand, engagement holes 81 are made at the positions corresponding to the engagement pawls 80 in the lower end of the pump cover 49. The V-shape engagement pawl 80 is inserted from below into the engagement hole 80 while compressed in the backward and forward direction, and the return portion 80*a* of the upper end portion engages the upper edge of the engagement hole 80, thereby fixing the housing circumferential side wall 66 to the pump cover 49. The fitting means 71 for mounting the housing upper wall 65 to the housing circumferential side wall 66 has the same structure as the fitting means 70. That is, referring to FIG. 8, the plural engagement pawls 85 projected upward in the V shape are formed at points in the upper end of the housing circumferential side wall 66, the engagement pawl 85 has the return portion 85*a* in the upper end portion thereof, and the engagement holes 86 are made at positions corresponding to the engagement pawls 85 in the housing upper wall 65.

Action and Effect of First Embodiment (1) Referring to FIGS. 9 and 10, even if the small fuel quantity remains in the fuel tank 10, e.g., even if the fuel is decreased to a level L1, the fuel flows mainly from the fuel flow hole 75 of the housing bottom wall 64 into the filter housing 61, and the fuel in the filter housing 61 is maintained at a level L1*a* identical to the level L1 outside the filter housing 61.

(2) The shape of the fuel filter 60 as seen from the above is extended outward from the region of the fuel pump 45 as seen from the above, and the shape of the fuel filter 60 as seen in the direction of the pump axis O1 of the fuel pump hangs outward from the region of the fuel pump 45 as seen in the direction of the pump axis O1. Therefore, the fuel suction area of the fuel filter 60 can largely be ensured to improve the fuel suction performance.

(3) Referring to FIGS. 9 and 10, when the vehicle jumps with the small fuel quantity remaining in the fuel tank, while the fuel outside the filter housing 61 in the fuel tank 10 swings largely and widely, the fuel in the filter housing 61 swings within the filter housing 61 substantially independently of the fuel outside the filter housing 61. Therefore, the bubble is hardly mixed into the fuel, and the generation of the air inhaling phenomenon can be suppressed in the fuel pump 45. Particularly, in the first embodiment, the upper and lower portions of the fuel filter 60 are covered with the housing upper wall 65 and the housing bottom wall 64. Therefore, even if the body is rapidly vertically moved due to the jump and landing of the vehicle, the fuel can be prevented from flying over from the filter housing 61 and the bubble can be prevented from being mixed into the fuel.

(4) Referring to FIG. 10, when the vehicle runs on the upward slope with the small fuel quantity remaining in the fuel tank, while the fuel outside the filter housing 61 in the fuel tank 10 is largely moved backward like a level L2, the fuel in the filter housing 61 is moved backward within the filter housing 61 substantially independently of the fuel outside the filter housing 61. Therefore, the fuel filter 60 is hardly exposed to the air, so that the generation of the air inhaling phenomenon can be suppressed. Similarly to the case in which the vehicle runs on the upward slope, when the vehicle runs on the downward slope, the fuel filter 60 is hardly exposed to the air, so that the generation of the air inhaling phenomenon can be suppressed.

(5) Referring to FIG. 9, when the vehicle is inclined onto the right side with the small fuel quantity remaining in the fuel tank, while the fuel outside the filter housing 61 in the fuel tank 10 is largely moved onto the right side like a level L3, the fuel in the filter housing 61 is moved onto the right side within the filter housing 61 substantially independently of the fuel outside the filter housing 61. Therefore, the fuel filter 60 is hardly exposed to the air, so that the generation of the air inhaling phenomenon can be suppressed. Similarly to the case in which the vehicle is inclined onto the right side, when the vehicle is inclined onto the left side, the fuel filter 60 is hardly exposed to the air, so that the generation of the air inhaling. phenomenon can be suppressed.

(6) The structure in which the filter housing 61 is mounted to the fuel pump unit 25 is adopted in the first embodiment. Therefore, when the filter housing 61 is previously mounted to the fuel pump unit, the filter housing 61 can be assembled along with the fuel tank 10 to facilitate the assembly work.

(7) As shown in FIG. 7, when the fuel flow holes 75 are made in the central portion of the right and left width of the front end portion of the housing bottom wall 64 and the right and left end portions of the rear portion, the fuel can be cause to flow promptly into the filter housing 61 even if the vehicle is inclined backward and forward or right and left. That is, because the fuel flow holes 75 are made in the right and left end portions of the filter housing 61, even if the vehicle is inclined right and left, the filter housing 61 can promptly be filled with the fuel from the fuel flow hole 75 located on the side inclined downward. Additionally, because the fuel flow holes 75 are made in the front and rear end portions of the filter housing 61, even if the vehicle is inclined backward and forward, the filter housing 61 can promptly be filled with the fuel from the fuel flow hole 75 located on the side inclined downward.

(8) As shown in FIG. 5, in the inner space of the filter housing 61 of the first embodiment, the lower space portion is formed narrower than the upper space portion, and the fuel filter 60 is disposed in the narrower lower space portion, so that the exposure of the fuel filter 60 to the air can further be reduced.

(9) As shown in FIG. 7, since the plural fuel flow holes 75 are made in the filter housing 61 while dispersed backward and forward and right and left. Even if the vehicle is inclined in any direction, the fuel floes into the fuel housing 61 through one or more of the fuel flow holes 75.

Second Embodiment

Figure 11:
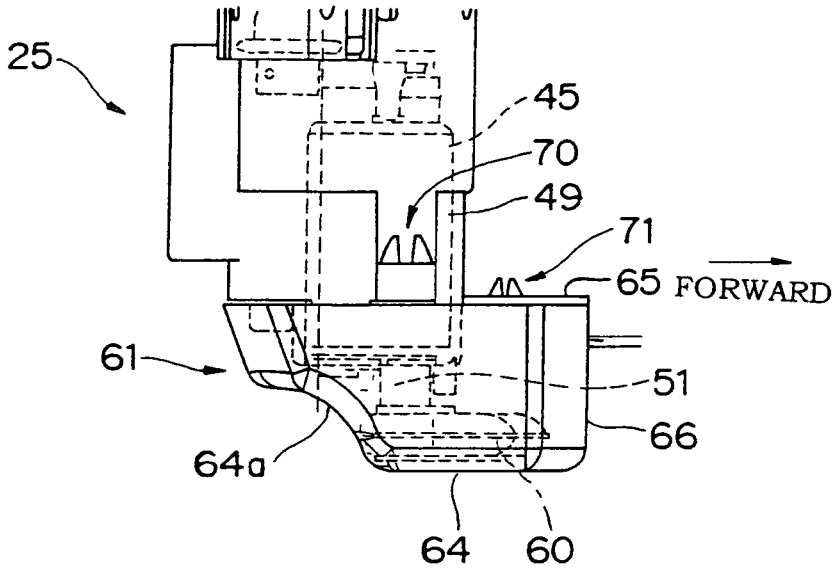
FIG. 11 is a right side view showing a fuel pump unit of a vehicle fuel feed system according to a second embodiment of the present invention.

FIG. 11 shows a fuel pump unit of a fuel feed system for a vehicle according to a second embodiment of the present invention. The second embodiment differs from the first embodiment in a part of the structure of the filter housing 61. That is, the housing upper wall 65 is integrally formed with the pump cover 49. Similarly to the first embodiment, the housing circumferential side wall 66 and the housing bottom wall 64 are formed independently of the housing upper wall 65, and are formed in the cup shape. In the second embodiment, other structures are similar to those of the first embodiment, and the same component or portion is designated by the same numeral. Accordingly, in the second embodiment, the production and assembly work of the housing upper wall 65 can easily be performed in addition to the effect of the first embodiment.

Third Embodiment

Figure 12:
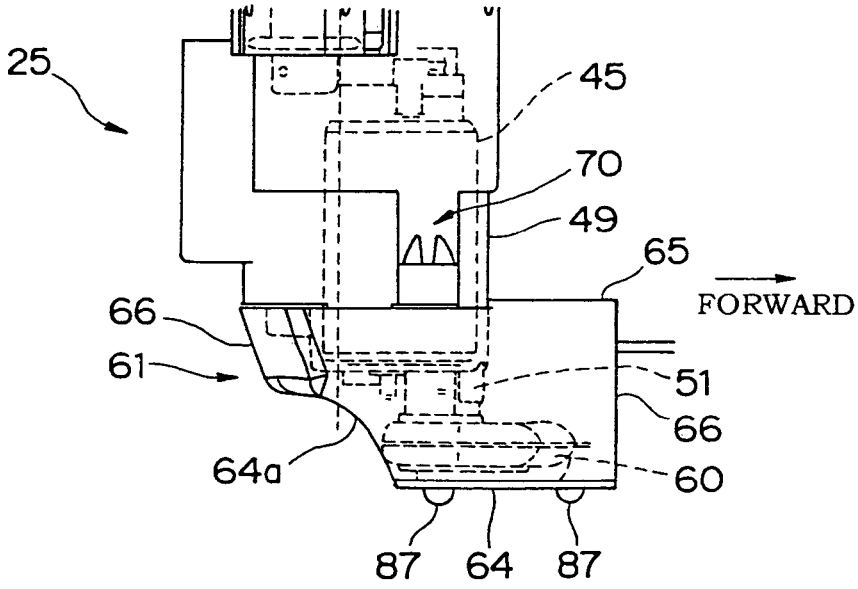
FIG. 12 is a right side view showing a fuel pump unit of a vehicle fuel feed system according to a third embodiment of the present invention.

FIG. 12 shows a fuel pump unit of a fuel feed system for a vehicle according to a third embodiment of the present invention. The third embodiment differs from the first embodiment in a part of the structure of the filter housing 61. That is, the housing upper wall 65 and the housing circumferential side wall 66 are integrally formed, the housing bottom wall 64 is formed independently of the housing upper wall 65 and the housing circumferential side wall 66, and the housing bottom wall 64 is fixed to the lower end of the housing circumferential side wall 66 by fitting means such as screws 87. In the third embodiment, other structures are similar to those of the first embodiment, and the same component or portion is designated by the same numeral. Accordingly, in the third embodiment, the production and assembly work of the housing upper wall 65 can easily be performed in addition to the effect of the first embodiment.

Figure 13:
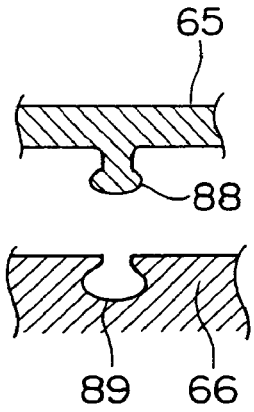
FIG. 13 is a sectional view showing another example of the housing upper wall attaching means.

Other Embodiments (1) FIG. 13 shows a modification of the means for mounting the housing upper wall 65 to the housing circumferential side wall 66. In the structure of FIG. 13, a projection 88 projected downward is formed in the housing upper wall 65 and has an expanded lower end portion. Meanwhile, a recess 89 whose inside is expanded is formed at the upper end of the housing circumferential side wall 66. The expanded lower end portion of the projection 88 is press-fitted in the recess 89. Accordingly, in addition to the effect of the first embodiment, the engagement pawl 88 has the simpler shape in comparison with the engagement pawl 80 shown in FIG. 5, so that the engagement pawl 88 can easily be produced. Additionally, an appearance is improved because the engagement portion between the mush-room projection 88 and the recess 89 is hardly shown from the outside.

Figure 14:
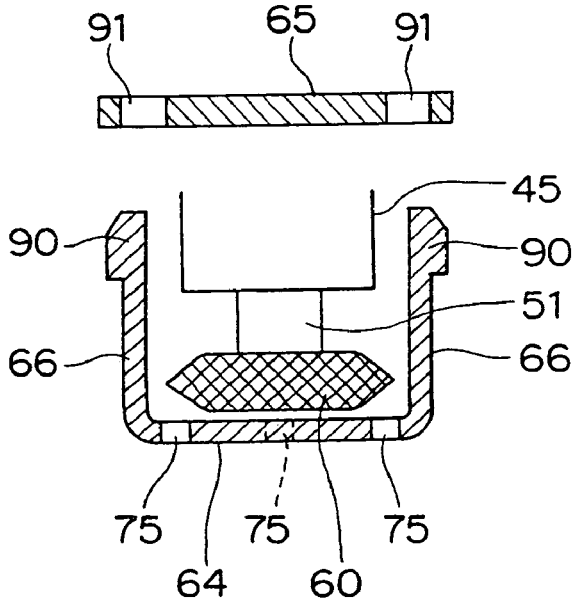
FIG. 14 is a sectional view showing still another example of the housing upper wall attaching means.

(2) FIG. 14 shows another modification of the means for mounting the housing upper wall 65 to the housing circumferential side wall 66. In the structure of FIG. 14, an arrowhead-shape engagement pawl 90 is formed at the upper end of the housing circumferential side wall 66, an engagement hole 91 is made in the housing upper wall 65, and the arrowhead-shape engagement pawl 90 is press-fitted in the engagement hole 91. Accordingly, in addition to the effect of the first embodiment, the engagement pawl 90 has the simpler shape in comparison with the engagement pawl 80 shown in FIG. 5, so that the engagement pawl 90 can easily be produced.

(3) In the first embodiment, the shape of the fuel filter 60 as seen from the above is extended forward from the region of the fuel pump as shown in FIG. 7. The present invention can also be applied to a fuel feed system in which the fuel filter 60 is extended toward at least one of all the directions from the region of the fuel pump as seen from the above. For example, the present invention can be applied to the fuel feed system in which the fuel filter 60 is extended toward at least one of the backward, left, right, forward right, backward right, forward left, and backward left directions.

(4) As shown in FIG. 5, in the structure in which the filter housing 61 is formed independently of the fuel pump unit 25, in addition to the fitting means in which the engagement pawl and the engagement hole are used as described above, various fitting means such as a screw and a bonding agent can be applied as the fitting means 70 for mounting the filter housing 61 to the fuel pump unit 25.

(5) In each embodiment, the filter housing 61 includes the housing upper wall 65 and the housing bottom wall 64. Alternatively, the filter housing 61 may include only one of the housing upper wall 65 and the housing bottom wall 64.

(6) In each embodiment, the filter housing 61 is mounted to the pump cover 49 of the fuel pump unit 25. Alternatively, the whole of the filter housing 61 may be mounted to the bottom wall 32 of the fuel tank 10, or the housing bottom wall 64 and the housing circumferential side wall 66 may be mounted to the bottom wall 32 of the fuel tank 10 or integrally formed with the bottom wall 32 of the fuel tank 10. Additionally, various structures can be adopted such as only the housing bottom wall 64 may be integrally formed with the bottom wall 32 of the fuel tank 10.

(7) In the first to third embodiments, as shown in FIG. 7, the fuel flow hole 75 is formed in the housing bottom wall 64. Alternatively, the fuel flow hole 75 may be formed in the lower end portion of the housing circumferential side wall 66.

(8) In the first to third embodiments, as shown in FIG. 5, the fuel pump unit 25 is mounted to the upper wall 31 of the fuel tank 10. Alternatively, a horizontal flat portion may be formed in the circumferential side wall 33 of the fuel tank 10, and the fuel pump unit 25 is supported in the hanging manner in the flat portion of the circumferential side wall 33.

(9) In each embodiment, as shown in FIG. 5, the fuel pump unit 25 is mounted to the fuel tank 10 such that the pump axis O1 of the fuel pump 45 is extended in the vertical direction, and the fuel filter 60 is attached to the fuel pump 45 so as to be perpendicular to the pump axis O1. The present invention includes a structure in which the fuel pump unit 25 is mounted to the fuel tank 10 while the pump axis O1 is inclined with respect to the vertical direction. In such cases, it is assumed that the shape of the filter as seen in the direction of the pump axis O1 of the fuel pump 45 is extended outward from the region of the fuel pump 45 in the direction of the pump axis O1. Specifically, the shape of the fuel filter 60 as seen in the direction of the pump axis O1 and the region of the fuel pump 45 as seen in the direction of the pump axis O1 shall mean the shape and region when the fuel filter 60 and fuel pump 45 are projected to a virtual plane perpendicular to the pump axis O1 respectively.

Figure 15:
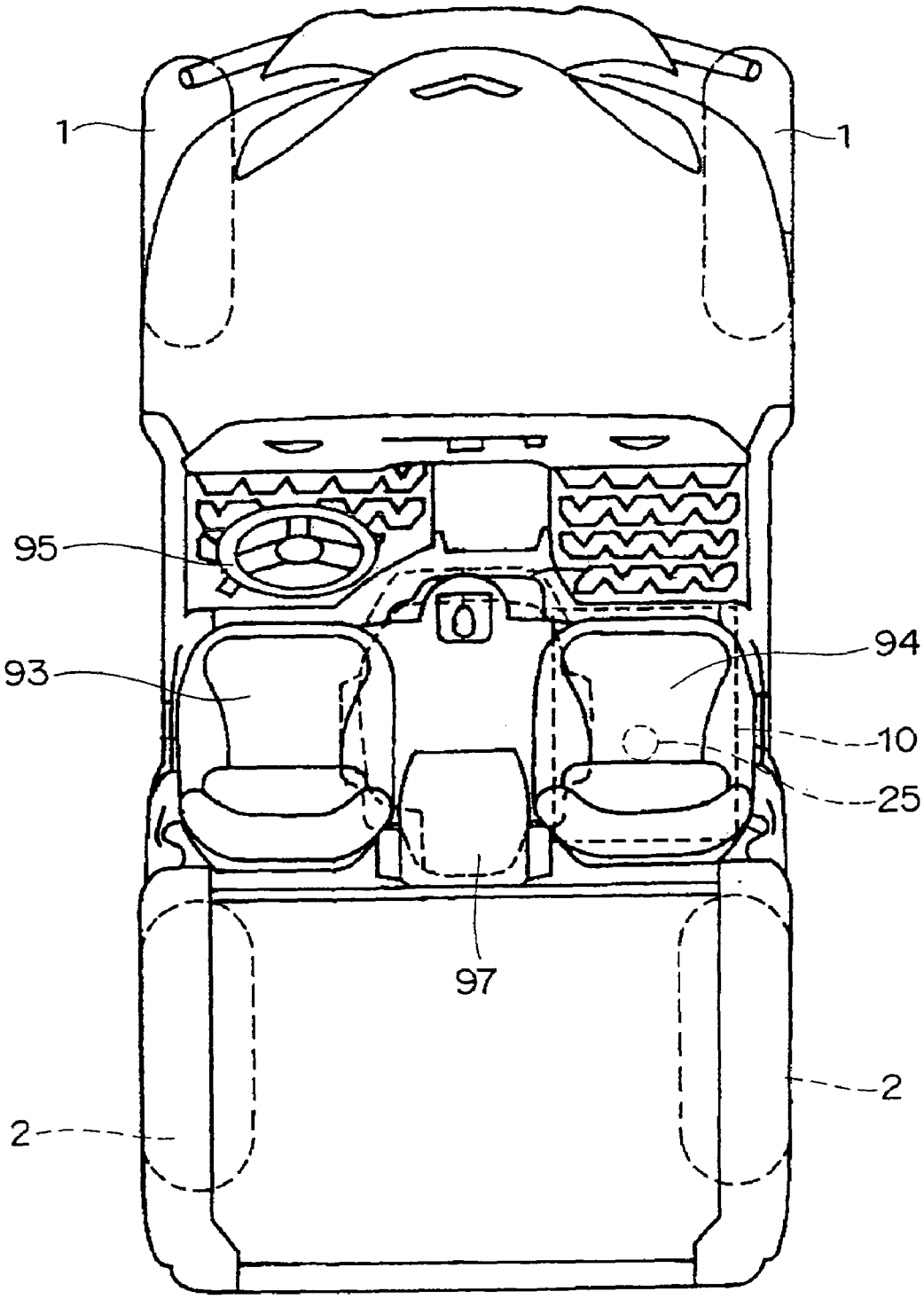
FIG. 15 is a plan view showing a versatile practical four-wheeled vehicle provided with a fuel feed system according to the present invention.
Figure 16:
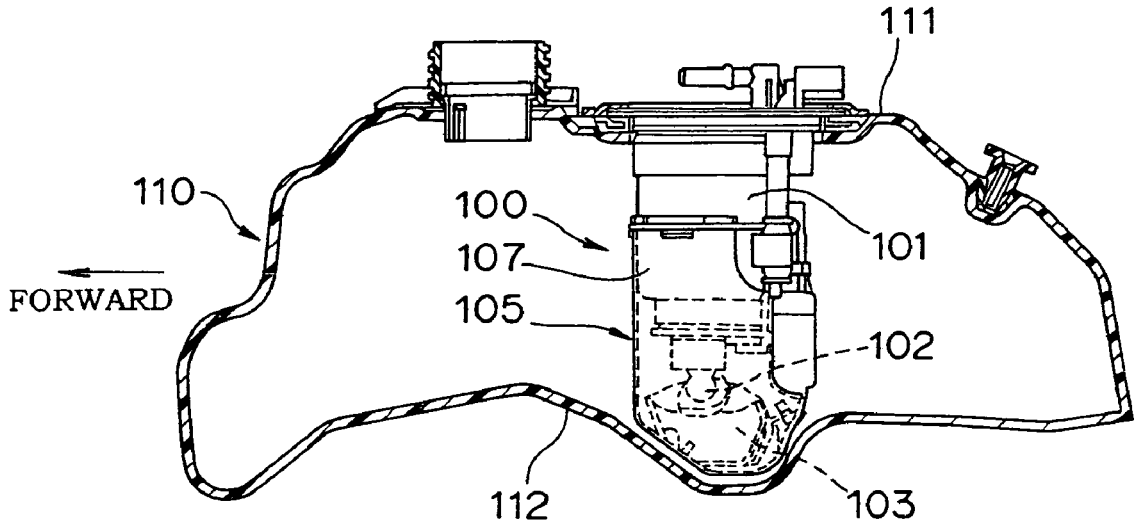
Fig. 16 PRIOR ART
FIG. 16 is a longitudinal sectional view of a conventional vehicle fuel feed system.

(10) As shown in FIG. 15, the fuel feed system for the vehicle of the present invention can also be applied to a versatile practical four-wheeled vehicle including seats 93 and 94 and a round handle 95, i.e., so-called "Utility vehicle". In the versatile practical four-wheeled vehicle, a engine room is provided below the driving seat 93 and the assistant seat 94, an engine 97 is mounted at a position between the seats 93 and 94 in the engine room, the fuel tank 10 is provided below the assistant seat 94, and the fuel pump unit 25 of the present invention is provided in the central portion in the right and left width and backward and forward width of the fuel tank 10.

(11) The fuel feed system for the vehicle of the present invention can also be applied to a motor cycle.

(12) The present invention is not limited to the above-described embodiments, various modifications and changes can be made without departing from the spirit and scope of claims of the invention.

What is claimed is:

1. A fuel feed system for a vehicle comprising: a fuel pump unit accommodated in a fuel tank, the fuel pump unit including a fuel pump and a fuel filter connected to a lower-end fuel suction portion of the fuel pump, wherein the filter is shaped so as to extend outward from a region of the fuel pump as seen from above, a filter housing for covering upper and lower portions of the filter, front and rear portions of the filter and right and left portions of the filter is provided with the fuel pump unit, and the filter housing has a fuel flow hole or opening for communicating between inside and outside of the filter housing at a lower end portion of the filter housing or adjacent the lower end portion of the filter housing.

2. The fuel feed system for the vehicle as claimed in claim 1, wherein the fuel filter is formed in a flatten shape and arranged substantially in a horizontal position or arranged perpendicular to a pump axis.

3. The fuel feed system for the vehicle as claimed in claim 1, wherein the filter housing is supported by the fuel pump unit.

4. The fuel feed system for the vehicle as claimed in claim 1, wherein the filter housing includes a housing upper wall for covering the upper portion of the fuel filter, a housing bottom wall for covering the lower portion of the fuel filter, and a housing circumferential side wall for covering the front and rear portions and the right and left portions of the fuel filter, the housing bottom wall is formed integrally with the housing circumferential side wall, and the housing upper wall is formed independently of the housing bottom wall and the housing circumferential side wall.

5. The fuel feed system for the vehicle as claimed in claim 4, wherein the housing upper wall is formed integrally with a pump cover of the fuel pump unit.

6. The fuel feed system for the vehicle as claimed in claim 1, wherein the filter housing includes a housing upper wall for covering the upper portion of the fuel filter, a housing bottom wall for covering the lower portion of the fuel filter, and a housing circumferential side wall for covering the front and rear portions and the right and left portions of the fuel filter, the housing upper wall is formed integrally with the housing circumferential side wall, and the housing bottom wall is formed independently of the housing upper wall and the housing circumferential side wall.

7. The fuel feed system for the vehicle as claimed in claim 1, wherein a length of an upper space portion of the filter housing in the backward and forward direction is larger than a length of a lower space portion of the filter housing in the backward and forward direction, and the fuel filter is accommodated in the lower space portion of the filter housing.

8. A fuel feed system for a vehicle comprising: a fuel pump unit accommodated in a fuel tank, the fuel pump unit including a fuel pump and a fuel filter connected to a lower-end fuel suction portion of the fuel pump, wherein the fuel pump is a rotary pump, the fuel filter is shaped so as to extend outward from a region of the fuel pump region as seen in a pump axis direction, a filter housing for covering upper and lower portions of the filter, front and rear portions of the filter and right and left portions of the filter is provided with the fuel pump unit and the filter housing has a fuel flow hole or opening for communicating between inside and outside of the filter housing at a lower end portion of the filter housing or adjacent the lower end portion of the filter housing.

9. A vehicle for irregular ground comprising: a fuel feed system, the fuel feed system having a fuel pump unit accommodated in a fuel tank, the fuel pump unit including a fuel pump and a fuel filter connected to a lower-end fuel suction portion of the fuel pump, wherein the fuel filter is shaped so as to be extended outward from a region of the fuel pump as seen from above, a filter housing for covering upper and lower portions of the filter, front and rear portions of the filter and right and left portions of the filter is provided with the fuel pump unit, and the filter housing has a fuel flow hole or opening for communicating between inside and outside of the filter housing at a lower end portion of the filter housing or adjacent the lower end portion of the filter housing.

10. The vehicle as claimed as claim 9, wherein the vehicle is a four-wheeled vehicle having a pair of front wheels and a pair of rear wheels, the fuel tank is arranged at a center portion in a right and left width of the vehicle, and the fuel pump unit is arranged at a center portion in a right and left width of the fuel tank.

11. The vehicle as claimed as claim 10, wherein the fuel tank is arranged between a right rear wheel and a left rear wheel.

* * * * *